United States Patent [19]

Martyak et al.

[11] Patent Number: 4,711,705

[45] Date of Patent: Dec. 8, 1987

[54] ACTIVATION COMPOSITION AND METHOD FOR FORMING ADHERENT CHROMIUM ELECTRODEPOSITS ON FERROUS METAL SUBSTRATES FROM HIGH ENERGY EFFICIENT BATHS

[75] Inventors: Nicholas M. Martyak; John A. Corsentino, both of Hazlet; Warren H. McMullen, E. Brunswick, all of N.J.

[73] Assignee: M&T Chemicals Inc., Woodbridge, N.J.

[21] Appl. No.: 4,374

[22] Filed: Jan. 15, 1987

[51] Int. Cl.[4] ..... C25D 5/36; C25F 3/06

[52] U.S. Cl. ..... 204/34; 204/129.75

[58] Field of Search ..... 204/129.75, 129.8, 34

[56] References Cited

U.S. PATENT DOCUMENTS

| | | | |
|---|---|---|---|
| 4,163,701 | 8/1979 | Schepacz | 204/129.75 |
| 4,585,530 | 4/1986 | McMullen | 204/34 |
| 4,619,742 | 10/1986 | Pliefke | 204/34 |

*Primary Examiner*—T. M. Tufariello

*Attorney, Agent, or Firm*—S. H. Parker; R. Bright

[57] ABSTRACT

An activation composition and method for producing chromium electrodeposits having excellent adhesion on both soft and hardened ferrous substrates from high energy efficient chromium baths is described. The activation composition is a solution containing iodate and fluoroborate ions, optionally with cerium ion as a stabilizer. The method includes electrolytically etching the substrate in the activation solution, preceded or followed by reverse etching in chromic acid. The chromium electrodeposit can be carried out effectively to provide the desired adherent deposit from a high energy efficient (HEEF) chromium plating bath.

16 Claims, No Drawings

ACTIVATION COMPOSITION AND METHOD FOR FORMING ADHERENT CHROMIUM ELECTRODEPOSITS ON FERROUS METAL SUBSTRATES FROM HIGH ENERGY EFFICIENT BATHS

BACKGROUND OF INVENTION

1. Field of Invention

This invention relates to electrodeposition of chromium on basis metals, and, more particularly, it is concerned with an activation process by which an adherent chromium electrodeposit is formed on ferrous metal substrates using a high energy efficient chromium plating bath.

2. Description of the Prior Art

The use of high efficiencv chromium plating processes has been hampered by the inability to obtain coatings with adequate adhesion to certain basis metals. Chromium plating baths containing halides particularly have exhibited such adhesion problems. These baths are of the type disclosed in Mitsui, J7B-33941 (September, 1978); Dillenberg U.S. Pat. No. 4,093,522, Perakh et al., U.S. Pat. No. 4,234,396; and Chessin, U.S. Pat. Nos. 4,450,550; 4,472,249 and 4,588,481. The problem has been attributed to the presence of a halide which may interfere at the initiation of deposition.

In order to obtain an adequate bond, as measured by ASTM B 571-79, with typical chromium plating solutions, such as those using a solution of chromic acid and catalysts such as sulfate, or sulfate in combination with various fluorides, it is usually necessary to reverse or anodically etch a ferrous workpiece in the plating solution, or in a separate chromium acid containing solution at a predetermined current density for a predetermined time.A table which lists the time lengths for such an etching process is found in "Metal Finishing" 80 (5) 65–8 (1982) by C. H. Peger.

Anodic chromic acid treatments for 400 stainless steel alloys and for low and high carbon steel are disclosed in "48th Metal Finishing Guidebook-Directory" 78, 188–202 (1980) by A. Logozzo. Also recommended therein are techniques for 300 stainless, for nickel alloys and for cast iron.

Brune and McEnally, in "Plating" 42, 1127–32(1955), describe the use of a magnesium sulfate-sulfuric acid anodic etch solution for preparing ferrous parts for plating. Similarly, ASTM Specification B-242-49T suggests the application of an anodic etch using a sulfuric acid solution containing sodium sulfate. ASTM B177-68 describe the use of sulfuric acid or chromic acid as activators for chromium electroplating on steel for engineering use.

Chessin, in U.S. Pat. No. 4,450,050, described an activation pretreatment for bonding high efficiency chromium electrodeposits on a metal substrate, which process is characterized bv the step of first plating the substrate metal with iron or an iron alloy from an iron salt containing bath.

Hermann, in U.S. Pat. No. 4,416,758, activates metal substrates in an aqueous alkaline cyanide containing solution using current which is periodically reversed, followed by rinsing and chromium plating.

McMullen et al., in U.S. Pat. No. 4,585,530, describes an activation process using a substantially neutral solution of an alkali metal sulfate.

It has been found that when these prior procedures are employed with high efficiency chromium plating baths for ferrous metal substrates which includes both hardened and unhardened (soft) parts, the chromium deposits do not have adecuate adhesion to the part. It is believed that the reducing conditions at the cathode at the initiation of deposition causes the halide ion in the bath to be reduced to a form which interferes with the molecular bonding of the chromium to the substrate. In any event the use of high energy efficiency (HEEF) chromium plating for ferous substrates is limited bv the problem of inadequate adhesion.

Accordingly, it is an object of this invention to provide an improved process for forming adherent chromium electrodeposits, particularly from high energy efficient baths, on ferrous metal substrates.

Another object herein is to provide an activation solution for pretreating a ferrous metal substrate before electrodepositing chromium thereon, which solution is stable over prolonged periods.

Still another object is to provide an activation solution for electrolytically etching, preferably, anodically etching, a ferrous metal substrate in preparation for electrodepositing an adherent chromium metal deposit thereon from a high energy efficient bath, where the degree of adherence of the chromium deposit is relatively independent of the kind of ferrous metal present in the substrate.

Yet another object herein is to provide adherent and smooth chromium deposits on both hardened and unhardened ferrous metal substrates from a high energy efficient chromium electroplating bath.

SUMMARY OF THE INVENTION

The adherence oroblems encountered with the prior art systems for electrodepositing chromium on metal substrates from high energy baths are overcome herein by a process in which the substrate is activated in an activation solution which includes iodate and fluoroborate ions, optionally, with $C_e^{3+}$ therein.

In accordance with the present invention, an adherent and smooth chromium electrodeposit is obtained on a ferrous metal substrate, includinq both hardened and unhardened steel, by a process which comprises the steps of electrolytically etching the metal substrate in activation solution, and thereafter electrodepositing chromium metal thereon.

Preferably, the process also includes the step of subjecting the substrate, either before or after activation, to chromic acid reverse etching.

DETAILED DESCRIPTION OF THE INVENTION

While the process of the invention can be utilized for electrodepositing chromium from anv chromium bath, it used most advantageously for forming adherent chromium on a metal substrate from a high energy efficient chromium bath. Such baths contain a halide ion as an essential constituent. The presence of the halide ion can cause oroblems with adherence of the chromium deposit unless the metal substrate is given the pretreatment of the invention. High energy efficient (HEEF) baths are described for example in Chessin, U.S. Pat. Nos. 4,472,249 and 4,588,401.

In the present invention, the ferrous metal substrate is subjected to electrolytic etch, preferably anodic etching, in an activation solution of iodate and fluoroborate ions, preferably stabilized with cerium ions. The activated substrate also is reverse etched in chromic acid, and, thereafter, chromium is electrodeposited.

The electrolytic etching step is carried out for about 10 seconds to 10 minutes at a current density of about 0.1 asi to 10 asi, and a temperature ranging from room temperature to about 55° C.

In a typical run, a ferrous shock or strut substrate having both soft (unhardened) and furnace hardened regions is masked to define a plating area and given an alkaline cleaning treatment under anodic conditions in M&T Chemicals Inc. ES, for 60 seconds at 170° F. at 1.0 asi. After rinsing twice in cold water, the cleaned substrate is made anodic in an agueous activation solution comprising 15 g/1 of potassium iodate, 100 g/1 of fluoroboric acid, and optionally 12.5 g of cerium ion, added as cerium carbonate. The activation treatment was carried out at room temperature at a current density and for a period time which provides an ampere min./in$^2$ (amsi) value of 3. After cold water rinsing, the activated substrate was reverse etched in 450 g/1 of chromic acid, for 45 seconds at 55° C. Then chromium was electrodeposited from a HEEF-40 bath (U.S. Pat. No. 4,472,249) at 5 asi for 10 min. at 60° C. The adhesion of electrodeposited chromium on this substrate was excellent.

Activation solutions made in accordance with the invention are given in Table I. The constituents therein are presented in g/1.

TABLE I

ACTIVATION SOLUTIONS

| Constituent | Concentration Suitable | Preferred | Optimum |
|---|---|---|---|
| Essential | | | |
| $IO_3$ (iodate, present, for example, as potassium iodate) | 1–50 | 5–30 | 10–20 |
| $BF_4^-$ (fluoroborate, present for example, as fluoroboric acid) | 5–300 | 25–200 | 50–150 |
| Optional | | | |
| $Ce^{3+}$ (cerium ion, present for example, as cerium carbonate) | 0–30 | 3–25 | 5–20 |

The use of the activation solution of the invention for electrodepositing adherent chromium on a substrate having both soft and hard steel parts from high energy efficient (HEEF-40) baths is, shown in Table II below. The concentration again is expressed in g/l.

EXAMPLES OF INVENTION

TABLE II

| Ex. | Activation Solution Constituent | Conc. | Cr Bath | Adhesion of CR on Soft Steel | Substrate Hard Steel | Comments |
|---|---|---|---|---|---|---|
| 1. | $IO_3^-$ | 2 | HEEF-40 | Excellent | Excellent | Stable $IO_3^-$ |
| | $BF_4^-$ | 25 | (based on U.S. Pat. No. 4,472,249) | | | |
| 2. | $IO_3^-$ | 3 | HEEF-40 | Excellent | Excellent | Stable $IO_3^-$ |
| | $BF_4^-$ | 50 | (as above) | | | |

The effect on adhesion using solutions other than the activation solutions of the invention is shown below in Table III.

COMPARATIVE RESULTS

TABLE III

| Ex. | Activation Solution Constituent | Conc. | Cr Bath | Adhesion of Cr on Soft Steel | Substrate Hard Steel | Comments |
|---|---|---|---|---|---|---|
| A | $IO_3^-$ | 3 | HEEF-40 | Poor | Good | Rapid Loss of $IO_3^-$ |
| | $H_2SO_4$ | 20 | (as above) | | | |

The rapid loss of $IO_3$- experienced in the comoarative example above is attributed to the formation of ferrous ion in solutioun from the substrate during the anodic etch treatment. Such ferrous ion can reduce $IO_3$- to I-, with subsequent loss of I- as molecular iodine to the atmosohere. In the activation solution of the present invention, on the other hand, iodate is stabilized by complexing of ferrous ion with fluoride produced from fluorobate ion to form an insoluble ferrous fluoride compound. Further stabilization of iodate is afforded by complexation with cerium ion, when present in the activation solution.

Preferably, the reverse chromic acid etch step is carried out after activation and for about 1 minute or less, for example, 30–60 seconds, at about 5 asi.

While preferred ranges for the constituents of the activation solution are given herein, it will be understood that higher amounts of, for example, iodate or cerium ions, may be used without adversely affecting the kind of adhesion realized herein. Furthermore, there are no ill effects of using rather long transfer times between the chromic acid reverse etch step and HEEF-40 chromium plating. While activation may follow the chromic acid reverse etch, this sequence is not recommended because of the possibility of drag-in of fluoride ion into the HEEF-bath.

The mechanism of action of the activation solution and process of the present invention is not well understood at present. However, its effect is believed to reside in the formation of a thick iron-chrome oxide film during the anodic etching step the chromium layer can bond rapidly either to or through this oxide film before iodide ion in the bath attach itself to the substrate. It is also believed that the activation treatment herein may remove any amorphous oxide, which are present, layer broken or deformed crystals surrounded by carbides and, thus presenting a homogeneous surface which is more receptive to an adherent chromium electrodeposition thereon.

Although the invention has been described with reference to certain preferred embodiments thereof, it will be understood that changes and modifications may be made which are within the skill of the art. Accordingly it is intended to be bound only by the appended claims.

We claim:

1. An activation composition for preparing a metal substrate to receive an adherent chromium electrodeposit thereon comprising a solution of iodate and fluoroborate ions.

2. An activation composition according to claim 1 including cerium ions therein.

3. An activation composition according to claim 1 comprising an aqueous solution of about 1–50 g/1 of iodate and about 5–300 g/1 of fluoroborate ions.

4. An activation composition according to claim 3 further including up to about 30 g/1 of cerium ions.

5. An activation composition according to claim 1 comprising about 5–30 g/1 of iodate and about 25 g/1 of fluoroborate ions.

6. An activation composition accordino to claim 5 including about 3–25 g/1 of cerium ions.

7. An activation composition according to claim 1 comprising about 10–20 g/1 of iodate and about 25–200 g/1 of fluoroborate ions.

8. An activation composition according to claim 7 stabilized by including about 5–20 g/1 of cerium ions.

9. An activation composition according to claim 2 wherein said solution is an aqueous solution.

10. A method of forming an adherent chromium electrodeposit on a metal substrate comprising:

(a) electrolytically etching said substrate in an activation solution comprising iodate and fluoroborate ions, and (b) electrodepositing chromium thereon.

11. A method according to claim 10 in which said activation solution includes cerium ions therein.

12. A method according to claim 10 in which said substrate is a ferrous metal substrate.

13. A method according to claim 12 in which said ferrous metal substrate includes both soft and hardened steel parts.

14. A method according to claim 10 in which said chromium is electrodeposited from a high energy efficient chromium bath.

15. A method according to claim 10 further including the step of subjecting said substrate to an anodic chromic acid etch either before or after treatment in the activation solution.

16. A method according to claim 10 in which said step (a) is carried out anodically.

* * * * *